United States Patent [19]

Trent et al.

[11] Patent Number: 4,607,888

[45] Date of Patent: Aug. 26, 1986

[54] METHOD OF RECOVERING HYDROCARBON USING MINING ASSISTED METHODS

[75] Inventors: Robert H. Trent, Longmont, Colo.; W. Ray Oakley, Douglas, Wyo.

[73] Assignee: New Tech Oil, Inc., Spokane, Wash.

[21] Appl. No.: 563,184

[22] Filed: Dec. 19, 1983

[51] Int. Cl.[4] ..... E21C 41/10; E21B 43/40

[52] U.S. Cl. ..... 299/2; 166/50; 166/265

[58] Field of Search ..... 299/2, 7; 166/265, 50

[56] References Cited

U.S. PATENT DOCUMENTS

| | | | |
|---|---|---|---|
| 1,506,920 | 9/1924 | De Chambrier | 299/2 |
| 1,520,737 | 12/1924 | Wright | 166/265 |
| 1,634,235 | 6/1927 | Ranney | 299/2 |
| 1,660,187 | 2/1928 | Ehrat | 166/50 |
| 1,667,269 | 4/1928 | Ranney | 299/2 |
| 1,722,679 | 7/1929 | Ranney | 299/2 |
| 1,804,692 | 5/1931 | Jackson | 299/2 |
| 1,811,561 | 6/1931 | Ranney | 299/2 |
| 1,811,562 | 6/1931 | Ranney | 299/2 |
| 1,812,305 | 6/1931 | Ranney | 299/2 |
| 1,842,098 | 1/1932 | Howard | 299/2 |
| 1,851,446 | 3/1932 | Ranney | 299/2 |
| 1,870,869 | 8/1932 | Ranney | 299/2 |
| 1,884,858 | 10/1932 | Ranney | 299/2 |
| 1,884,859 | 10/1932 | Ranney | 299/2 |
| 1,935,643 | 11/1933 | Laughlin | 299/2 |
| 2,383,496 | 8/1945 | Nebolsine | 166/50 |
| 2,404,341 | 7/1946 | Zublin | 166/303 |
| 3,960,213 | 6/1976 | Striegler et al. | 166/272 |
| 3,960,214 | 6/1976 | Striegler et al. | 166/272 |
| 3,986,557 | 10/1976 | Striegler et al. | 166/272 |
| 3,994,340 | 11/1976 | Anderson et al. | 166/272 |
| 4,020,901 | 5/1977 | Pisio et al. | 166/50 |
| 4,067,391 | 11/1978 | Dewell | 166/303 |
| 4,085,803 | 4/1978 | Butler | 166/303 |
| 4,099,570 | 7/1978 | Vandergrift | 166/303 |
| 4,099,783 | 7/1978 | Verty et al. | 299/2 |
| 4,114,689 | 9/1978 | Dismukes | 166/249 |
| 4,116,275 | 9/1978 | Butler et al. | 166/303 |
| 4,160,481 | 7/1979 | Turk et al. | 166/272 |
| 4,201,420 | 5/1980 | Likholai et al. | 299/2 |
| 4,227,743 | 10/1980 | Ruzin | 299/2 |
| 4,248,302 | 2/1981 | Churchman | 166/272 |
| 4,249,777 | 2/1981 | Morrell et al. | 299/4 |
| 4,257,650 | 3/1981 | Allen | 299/2 |
| 4,283,088 | 8/1981 | Tabakov et al. | 299/2 |
| 4,368,920 | 1/1983 | Tabakov et al. | 299/2 |
| 4,379,592 | 4/1983 | Vakhnin | 299/2 |
| 4,458,945 | 7/1984 | Ayler et al. | 299/2 |

OTHER PUBLICATIONS

G. S. Rice, "Mining Petroleum by Underground Methods", Bureau of Mines Bulletin 351, 1932.

L. C. Uren, Petroleum Production Engineering: Oil Field Exploration, 3rd Ed., McGraw-Hill (1953).

*Primary Examiner*—George A. Suchfield

*Attorney, Agent, or Firm*—Sigalos & Levine

[57] ABSTRACT

A method for recovering a desired fluid hydrocarbon from an underground porous formation having a bottom impermeable to the fluid hydrocarbon and containing the hydrocarbon and at least one other fluid having a specific gravity different from the hydrocarbon, comprising the steps of forming an excavation having a portion thereof below the porous formation; forming a plurality of openings extending from the portion of said excavation into said porous formation; inserting collection means into the porous formation through the openings to separately collect the hydrocarbon and the at least one other fluid; collecting a quantity of the at least one other fluid; circulating the collected at least one other fluid from the porous formation to a point below the porous formation and at least one time back through the porous formation to wash the hydrocarbon therefrom and to form, in the porous formation, a pool of the hydrocarbon and a substantially separate layer of the at least one other fluid; regulating the height of the hydrocarbon collection means and the volume of the collected at least one other fluid in the porous formation to maintain the hydrocarbon collection means in fluid communication with the pool of hydrocarbon; collecting the hydrocarbon from the pool thereof; and conveying the collected hydrocarbon to the surface.

11 Claims, 5 Drawing Figures

METHOD OF RECOVERING HYDROCARBON USING MINING ASSISTED METHODS

BACKGROUND OF THE INVENTION

The present invention relates to a method and a device for the recovery of desired fluid hydrocarbon from an underground porous formation. The typical porous formation to which this method and device relate is a porous oil and gas bearing sand entrapped underground between a fluid impermeable cap rock above and a fluid impermeable stratum below. The typical desired fluid is liquid of gaseous hydrocarbon. The present invention relates to a method and a system which solves or avoids problems associated with prior art methods and systems used to recover desired fluid hydrocarbons, such as oil or gas, from oil and gas bearing sands, which prior art is characterized by tunneling within or below the porous formation and drilling into the sands so that the desired fluid drains by the force of gravity into collection pits located on the floor of the tunnel.

Prior art methods and systems for using mine shafts or tunnels with oil drain pits for collecting oil drained from oil sands by the force of gravity have typically been called "oil-mining" systems or methods. In one early method, tunnels were driven horizontally through the impermeable cap rock above the oil bearing sand and square pits were dug vertically through the tunnel floor to the oil bearing sands a few feet below. The oil drained into these pits and was lifted periodically by a pneumatic device into a pipeline extending to surface tanks. This system was used in the Pechelbronn field near Hanover, Germany and is disclosed in G. S. RICE, U.S. BUREAU OF MINES.

Another variation of this method is known as the Ranney oil-mining system and is disclosed in L. C. UREN, PETROLEUM PRODUCTION ENGINEERING: OIL FIELD EXPLOITATION, 3d Ed. McGRAW-HILL (1953). In this system mine galleries or tunnels are driven in impermeable strata above or below the porous formation of oil bearing sand and holes are drilled into the porous formation at short intervals along these galleries. Fluid is withdrawn through pipes sealed into the drilled holes and is pumped to the surface through a system of drain pipes in the galleries.

Another method which has been proposed for mining oil from partially drained oil bearing sands involves drilling a vertical mine shaft through the porous formation and drilling long slanting holes radially in all directions from the shaft bottom into the oil sands. The oil was to drain from the sand through the radial slant holes into a pit or sump at the bottom of the shaft and was to be pumped to the surface.

There are problems associated with these prior art oil-mining systems. For example, where high pressure gases may be present in the porous formation the prior art methods may be ineffective because either the gas will escape directly into the tunnels, galleries, or shafts or the gas will force itself directly into the collection pipe system, thereby leaving the liquid unrecovered in the porous formation. Another problem associated with reservoirs in which both gas and liquid hydrocarbons exist in that a mixture of gas and liquid will be recovered in the pipe system, thereby creating difficulties both in pumping the mixture to the surface and in separating the mixture under conditions existing in collection vessels at the surface. Typically pumps are designed to pump either liquid or gas alone and do not work efficiently when pumping a mixture of both. Also, separation of the hydrocarbons at the surface may require complex procedures and may result in dangerous chemical reactions, which chemical reactions would not occur if the separation of the liquid from the gas was accomplished under the conditions existing in the underground formation.

Further problems associated with prior art oil-mining systems occur when undesired fluids, such as water or brine, exist in the porous formation. The prior art systems essentially drain all fluids indiscriminately. Pumping or transporting the entire mixture requires the expenditure of energy in pumping the undesired fluids to the surface. Also the prior art systems involve the expense and complication of separating the desired fluid hydrocarbon from the undesired fluid when the mixture reaches the surface.

SUMMARY OF THE INVENTION

The present invention alleviates many of these problems by providing a method and a means for separating the various fluids while they are still under the conditions existing in the porous formation. Thus, when liquid fluids are desired, such as oil, an appropriate efficient means may be used for collecting and for pumping the oil to the surface. When gaseous fluids, such as gaseous hydrocarbons, are desired, then the appropriate equipment for collecting and transporting gas to the surface may be used. Moreover, dangerous and often expensive surface separation techniques need not be employed since the separation is achieved in the present invention prior to transporting the desired fluids to the surface.

Also, since all the fluids are recovered separately, undesired fluid contained in the porous formation prior to recovery of the desired fluid may be left in place in the porous formation therefore alleviating problems associated with disposal of the undesired fluid in an ecologically acceptable manner.

Briefly, the present invention relates to a method of recovering a desired fluid hydrocarbon from an underground porous formation containing said hydrocarbon and having a fluid impermeable bottom thereto, comprising the steps of circulating at least one other fluid having a specific gravity different than that of said hydrocarbon through the porous formation to wash said hydrocarbon therefrom and to form separate pools of said hydrocarbon and a separate layer of said other fluid based on the difference in specific gravity of the fluids, and collecting said hydrocarbon from said separate pools from below said underground formation.

Also, the present invention relates to a device for recovering a hydrocarbon from an underground porous formation containing said hydrocarbon and having a fluid impermeable bottom thereto, comprising means for circulating at least one other fluid having a specific gravity different than that of said hydrocarbon through said porous formation to wash said hydrocarbon therefrom and to form a separate pool of said hydrocarbon and a separate layer of said other fluid, a pipe with a portion thereof inserted into the pool of said hydrocarbon from below said porous formation, whereby said hydrocarbon drains into said pipe by the force of gravity, and means for recovering said hydrocarbon from said pipe.

BRIEF DESCRIPTION OF THE DRAWINGS

These and other objects and advantages of the present invention may be had by referring to the following specifications and drawings in which like numerals indicate like components and in which.

DETAILED DESCRIPTION OF THE DRAWINGS

Figure 1:
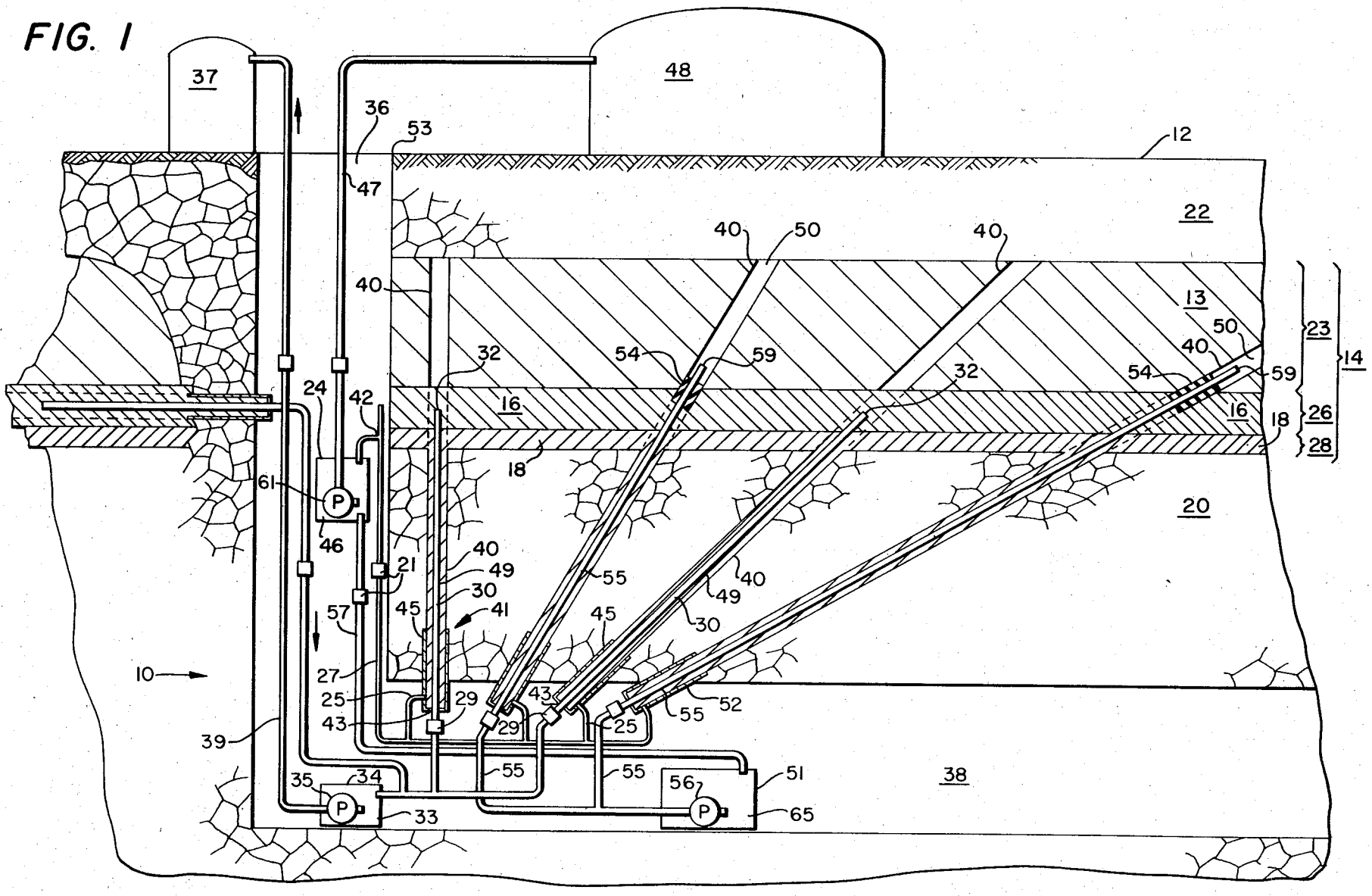
FIG. 1 is a schematic cross-sectional view of an underground porous formation and a schematic representation of a system for recovering a desired fluid hydrocarbon from the underground formation.

While the present invention can be utilized for the recovery of many economically valuable fluids from underground sources thereof, it is particularly intended for the recovery of fluid hydrocarbons, such as petroleum and gas, and the instant invention will be described in connection therewith. As used herein, the word "hydrocarbon" shall mean such fluid hydrocarbons.

The underground source of hydrocarbons may be any underground porous formation such as oil and/or gas bearing sand through which free fluid hydrocarbon may migrate to the bottom by the force of gravity or to areas of relatively lower pressure within said porous formation. In nature such underground porous formations may be found entrapped between a fluid impermeable bottom stratum and a fluid impermeable cap rock thereabove. Typically such porous formations contain a water saturated layer adjacent the fluid impermeable bottom stratum and a quantity of free liquid petroleum formed in a separate pool thereabove and maintained separately based on the specific gravity of the respective fluids. Also above the layer of liquid hydrocarbon there will be a portion of unsaturated porous formation containing fluid hydrocarbon interspersed through the interstices of the porous formation which fluid hydrocarbon may be liquid or gas or both. It should be understood that the arrangement of pools and layers within the porous formation depends upon the specific gravity of the various fluids contained therein such that the arrangement as described above may vary from situation to situation, which arrangement will not affect the applicability of the present inventive method or system; however, the description herein will be with reference to the typical arrangement as described above and as shown in the drawings as indicated below.

As best can be explained with reference to FIG. 1 which is a schematic cross section of a system 10 and method for recovering a desired fluid hydrocarbon 16 from an underground porous formation 14, said porous formation 14 has a bottom 20 impermeable to said fluid hydrocarbon 16 and contains said hydrocarbon 16 and at least one other fluid 18 having a specific gravity different from said hydrocarbon 16. The porous formation 14 is shown with said at least one other fluid 18 in a separate layer 28 and said desired fluid hydrocarbon 16 in a separate pool 26. Also shown is another region 23 of said porous formation 14 which may for example contain gaseous hydrocarbon 13 in a separate pool 23. The entire porous formation 14 is entrapped from below by stratum 20 which is impermeable to said fluid hydrocarbon and from above by stratum 22 which is impermeable to said fluid hydrocarbon 16.

The inventive method for recovering said desired fluid hydrocarbon 16 from said underground porous formation 14 as described above, comprises the steps of forming an excavation 36 having a portion 38 thereof below said porous formation 14, which excavation 36 may be a mine shaft 36 formed either adjacent said porous formation or through said porous formation 14 and sealed therefrom with a fluid impermeable shaft wall 53, such as a cement or concrete wall 53, and portion 38 thereof may be a tunnel 38 dug or blasted under said porous formation 14. Another step is forming a plurality of openings 40 extending from said excavation 36 into said porous formation 14 thereabove. This step may be completed in a variety of ways including drilling or boring holes 40 from within said tunnel portion 38 up through the impermeable stratum 20 and into the porous formation 14; alternatively holes may be drilled down from the surface 12 through the porous formation 14 and then into the excavation portion 38 so that openings 40 extend from said porous formation 14 and into said tunnel 38 of said excavation 36. Of course, where large quantities of relatively freely flowing hydrocarbon and other fluids exist in said porous formation, care must be taken to prevent the escape of said hydrocarbons and other fluids into said tunnel 38.

Another step is to insert a collection means 41 partially into said porous formation through said openings 40 from below to separately collect said hydrocarbon 16 and said at least one other fluid 18. With reference to FIG. 1 said collection means generally designated by numeral 41 may be understood. (Alternative embodiments of collection means 41 will be described more fully below with reference to other Figures.) Said collection means 41 may comprise a hydrocarbon collection means 49, which may comprise a pipe section 30, the length of which may be adjusted so that an open portion 32 thereof is in fluid communication with pool 26 of hydrocarbon 16. The height of pipe 30 may be adjusted by using any known coupling means 29 to attach different lengths of pipe 30, so that only pool 26 of hydrocarbon 16 is in fluid communication with end 32. Thus hydrocarbon 16 is collected separately therein. To prevent said other fluid 18 from escaping through said opening 40, collection means 41 further comprises a casing 45 which is cemented into said opening 40 where it interconnects with tunnel 38. Casing 45 guides pipe 30 through said opening 40 and a seal 43 is placed around pipe 30 where it goes through the casing 45. Pipe 30 is of a smaller diameter than the opening 40 so that when the other fluid 18 has a specific gravity greater than hydrocarbon 16, other fluid 18 will drain down through opening 40 and may be withdrawn through a fitting pipe 25. Thus, by blocking said opening 40 with that part of means 41 comprising said casing 45 and seal 43 around inserted pipe 30, the step of separately collecting a quantity of said at least one other fluid 18 is accomplished. Thus, by preventing said at least one other fluid 18 from freely escaping through said openings 40 so that said at least one other fluid 18 accumulates in a substantially separate layer 28 in and about said openings 40, and by permitting a quantity of said at least one other fluid 18 to enter and flow into fluid collection means 41, said other fluid 18 is collected separately from hydrocarbon 16.

Another step, in the method for recovering said hydrocarbon 16, is circulating said at least one other fluid 18 from said porous formation to a point below said porous formation (which point may for example be in fitting pipe 25), and at least one time back through said porous formation 14 to wash said hydrocarbon 16 therefrom and to form, in said porous formation 14, a pool 26 of said hydrocarbon 16 and a substantially separate layer 28 of said at least one other fluid 18. The step of circulating may be accomplished by transferring said collected other fluid 18 to a means 51 for circulating a quantity of said at least one other fluid 18. From pipe fitting 25, collected fluid 18 may be transferred through transfer line 27 into tank means 46 and from tank means 46 through a second transfer pipe 57 to circulation means 51. In the embodiment shown in FIG. 1 means 51 for circulating comprises a collection vessel 65 and an injection pump 56 connected in fluid communication with injection means 55 for conducting said at least one other fluid 18 from said pump 56 and for injecting other fluid 18 into said porous formation 14 above said separate layer 28 of said at least one other fluid 18 so that said at least one other fluid 18 flows down through said porous formation 14, by the force of gravity, washing said interspersed hydrocarbon 16 from said porous formation 14 to form, in said porous formation 14, a pool 26 of said hydrocarbon 16 and a substantially separate layer 28 of said at least one other fluid 18.

In the preferred embodiment the step of circulating said collected at least one other fluid 18 comprises the steps of: continuously draining said quantity of said at least one other fluid 18 which enters said fluid collection means 41 in said excavation 36 below said porous formation 14; continuously pumping said drained at least one other fluid 18 from said vessel 52 into a means 55 for injecting said at least one other fluid 18 above said separate layer 28 thereof; and continuously injecting said pumped at least one other fluid 18 into said porous formation above said separate layer 28 of said at least one other fluid 18, so that said at least one other fluid washes said hydrocarbon from said porous formation 14 as said at least one other fluid 18 returns through said porous formation 14 to said separate layer 28 thereof.

Another step in this inventive method is regulating the height of said hydrocarbon collection means 49, which means may be pipe 30 having open portion 32 thereon, and regulating the volume of said collected at least one other fluid 18 in said porous formation 14 to maintain said hydrocarbon collection pipe 30 in fluid communication, at 32, with said pool 26 of said hydrocarbon 16. Where the specific gravity of said at least one other fluid 18 is greater than that of said fluid hydrocarbon 16, the step of regulating may comprise the steps of adjusting the amount of said at least one other fluid 18 which drains from said porous formation; adjusting the rate of injection of said at least one other fluid 18 into said porous formation so that the volume of fluid 18 in said separate layer 28, and therefore the height of separate layer 28 in said porous formation, is regulated; and adjusting said inserted pipe 30 for collecting hydrocarbon to a position where a portion 32 thereof is above said separate layer 28 of said at least one other fluid 18 and said portion 32 is in fluid communication with said pool 26 of hydrocarbon 16 thereabove. These steps may for example be accomplished by adjusting the height to which fluid transfer line 27 extends up into excavation 36 so that the height of a junction 42 is adjusted. This establishes the height of separate layer 28 within the porous formation because fluid 18 drains through said junction 42 until the pressure at said junction 42 and in said separate layer 28 is equalized. Then, by continuously injecting the amount of fluid 18 which drains, the rate of injection will be such that a constant volume will be maintained within the porous formation. The constant volume raises separate layer 28 to a predetermined level. Pipe 30 may be adjusted to a height just above layer 28 so that hydrocarbon 16 will drain thereinto.

The inventive method also comprises the step of collecting said hydrocarbon 16 from said pool 26 thereof and the step of conveying said collected hydrocarbon 16 to the surface 12. The step of collecting said hydrocarbon 16 from said pool 26 thereof may be accomplished by draining said hydrocarbon through portion 32 of pipe 30 only while it is in fluid communication with said hydrocarbon 16. Said fluid hydrocarbon 16 which drains through pipe 30 will be collected for conveyance to the surface 12 at means 34 for conveying collected hydrocarbon 16 to the surface 12, which means 34 may comprise a recovery tank 33, a conveyance pump 35 and a conveyance line 39 by which the collected hydrocarbon 16 is conveyed to the surface 12 where it may be used or where it may be stored, as shown in FIG. 1, in a hydrocarbon storage tank 37.

The inventive method is highly effective where hydrocarbon 16 is interspersed through the interstices of the porous formation and particularly where liquid hydrocarbon clings to the porous formation. Circulating said other fluid 18 washes the interspersed petroleum from the formation 14. Draining the hydrocarbon 16 by the force of gravity through a plurality of openings 40 is a particularly effective method for recovering hydrocarbon from a formation which is a slow producer. All of the drained hydrocarbon may be collected, by way of a pipe 31 for interconnecting said collection means 41, into either a single means 34 for conveying said hydrocarbon 16 to the surface or into a number of conveying means 34 as necessary to efficiently pump the quantity of hydrocarbon 16 drained. Also more than one hydrocarbon for example liquid petroleum 16 and gas 13 may be separately and simultaneously recovered using the inventive collection means 41 shown in FIG. 5 which will be described more fully below.

It can also be seen with reference to FIG. 1 that the present invention also includes a system, shown generally as numeral 10, for recovering fluid hydrocarbon 16 from an underground porous formation 14 containing the fluid hydrocarbon 16 interspersed within porous interstices in the porous formation 14 containing at least one other fluid 18 having a specific gravity different than that of said hydrocarbon 16. The underground porous formation in which this system is most operable is acted upon by the force of gravity so that a portion of the at least one other fluid 18 settles into a substantially separate layer 28 horizontally through said porous formation 14 adjacent a formation the system 10 is suited for use in conjunction with an underground porous formation 14 which has an excavation 36 with a portion 38 thereunder and at least one opening 40 from said portion 38 up into said porous formation 14. The inventive system 10 comprises: means 51 partially inserted through said at least one opening 40 for circulating a quantity of said at least one other fluid 18 from a separate layer 28 thereof to a point below said formation and then up and through said porous formation 14 to wash said interspersed hydrocarbon 16 therefrom and into a pool 26 of said hydrocarbon 16 substantially separate from said substantially separate layer 28 of said at least one other fluid 18 and to return said at least one other fluid 18 to said substantially separate layer 28 thereof; means 49 inserted through said at least one opening 40 for collecting said hydrocarbon 16 from said pool 26 thereof from below; and means 34 in fluid communication with said means 49 for collecting said hydrocarbon for conveying said collected hydrocarbon to above the ground 12.

In one preferred embodiment of system 10 means 51 for circulating said quantity of fluid 18 comprises means 41 which includes: at least one casing 45 having a closeable portion 44 thereon affixed in said at least one opening 40 with said closeable portion 44 below said formation 14; a pumping means 56 below said formation 14 connected to said at least one casing 45 in fluid communication with said separate layer 28 of said at least one other fluid 18, which fluid communication may, for example, be through opening 40, casing 45, fitting 25, line 27, junction 42, tank 46 and second line 57 to pump 56; and injection means 55 connected in fluid communication with said pumping means 56 for conducting said at least one other fluid 18 from said pumping means 56 and for injecting said at least one other fluid 18 into said porous formation 14 above said separate layer 28 thereof so that said at least one other fluid 18 flows down through said porous formation by the force of gravity washing said interspersed hydrocarbon 16 from said porous formation 14 and into pool 26 thereof as said at least one other fluid 18 settles into said separate layer 28 thereof.

Figure 2:
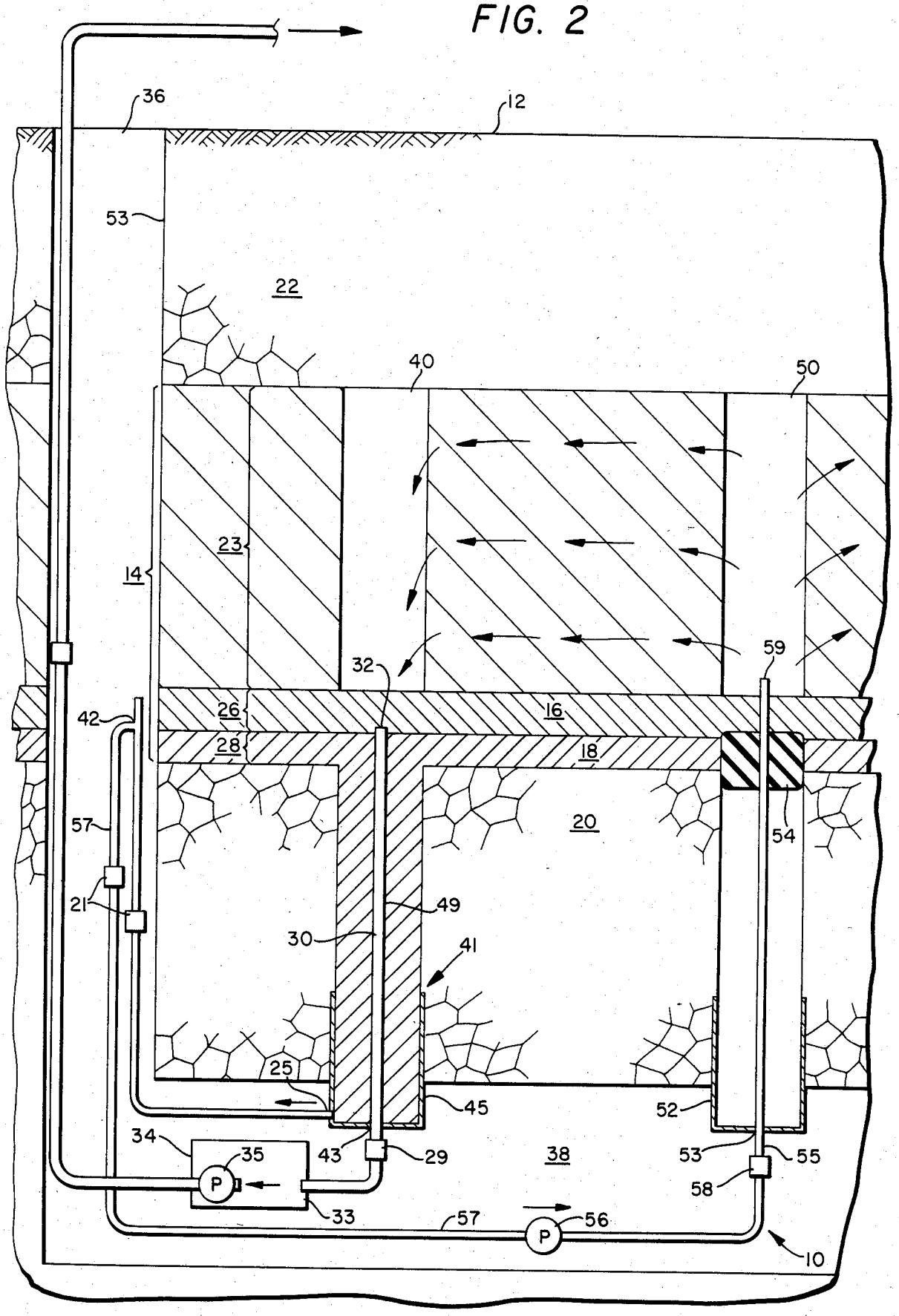
FIG. 2 is a schematic cross section of a system for recovering fluids from an underground porous formation showing means for circulating at least one other fluid through the porous formation.

With reference to FIG. 2 which is an enlarged schematic representation of one embodiment of a system 10 which more clearly shows one preferred embodiment of means 51 for circulating said at least one other fluid 18 where said at least one opening 40 comprises at least two openings 40 and 50. Thus it can be understood that the height of separate layer 28 in said porous formation may be adjusted by raising or lowering means 42 for adjusting the level of fluid 18. Means 42 may for example be a junction 42 connected to a first fluid transfer line 27 at a height in excavation 36 corresponding to the desired level of fluid layer 28 wherein the end of line 27 extends above the junction and is open to the atmosphere and a second fluid transfer pipe 57 communicates with said junction 42 and extends downward through excavation 36 and into tunnel 38 where it connects with pumping means 56. The height of the junction 42 may for example be adjusted using coupling means 21 wherein the length of fluid transfer lines 27 and transfer pipe 57 extending above said coupling means 21 may be increased or decreased, as for example, by adding sections of pipe 57 and transfer line 27 or removing sections of pipe 57 and transfer line 27 as desired to raise or lower the location of junction 42. Thus when junction 42 is adjusted so that the pressure in line 27 at junction 42 is equal to the pressure in the porous formation at the top of separate layer 28 then fluid 18 will rise in transfer line 27 until it reaches junction 42. Then fluid 18 will drain down through pipe 57 and then be pumped with pumping means 56 into means 55 for injecting, which means 55 for injecting is inserted into said second opening 50 and through sealing means 54 which is positioned in opening 50 so that hydrocarbon 16 and said at least one other fluid 18 are prevented from escaping through said opening 50 and down into tunnel 38. The injection means 55, which as shown in FIG. 1 may be an injection pipe 55, extends above said separate layer 28 and preferably above said pool 26 of said desired hydrocarbon 16. The height of injection pipe 55 may be adjusted with coupling means 58 whereby additional sections of injection pipe 55 may be added or sections may be removed as necessary to position the end 59 of injection pipe 55 in the porous formation 14 so that fluid 18 injected thereinto flows down through porous formation 14 so that interspersed hydrocarbon 16 is washed into pool 26 thereof and fluid 18 settles in separte layer 28 thereof. In the configuration shown in FIG. 2 said other fluid 18 has a specific gravity greater than said desired hydrocarbon 16 so that hydrocarbon 16 and fluid 18 settle into the layers as depicted. For example this will occur when other fluid 18 is water, brine or some other aqueous solution and desired fluid 16 is a liquid petroleum 16.

With reference again being had to FIG. 1 it can be understood that system 10 may further comprise means 24 for adjusting the amount of said other fluid 18 which is in porous formation 14. Adjustment means 24 may comprise adjustment tank 46 below junction 42 and in fluid communication therewith for receiving fluid 18 which drains therethrough. Means 24 further comprises adjustment pump 61 connected to fluid removal or addition line 47 so that fluid may be pumped from adjustment tank 46 through line 47 to storage means 48 at the surface 12 or alternatively fluid may be pumped from storage means 48 down into adjustment tank 46. Also connected to adjustment tank 46 is fluid transfer pipe 57 by which fluid 18 may be carried to injection pump 56 for injection into said formation 14 through injection pipe 55. Thus excess fluid 18 may be pumped from the system 10 to storage means 48 or if an insufficient amount of fluid 18 exists in porous formation 14 then additional fluid 18 may be pumped into porous formation 14 for the purpose of washing hydrocarbon 16 therefrom. However, though provisions can be made for adding or extracting other fluid 18, sufficient fluid 18 will typically exist in formation 14 so that it may simply be circulated and recirculated without ever pumping it to the surface. This saves energy and also alleviates the need for a storage means 48 or for a disposal area.

Referring then to FIG. 2, which shows system 10 without adjustment means 24 for adding other fluid 18, it can also be understood that system 10 comprises a means 54 for sealing injection opening 50. Sealing means 54 may be one or more packer seals covering the desired area in injection opening 50. To further insure that fluid does not escape through injection opening 50 and down into tunnel 38, a casing 52 is or can be cemented into injection opening 50 in the same manner as casing 45 is cemented into at least one opening 40. Also a seal 53 surrounds injection means 55 where it passes through casing 52. Where such a casing 52 is used in injection opening 50, injection means 55 and sealing means 54 thereon may in some cases be advantageously raised to above the top of pool 26, as shown in FIG. 1, so that injected fluid 18 is forced to go through a larger portion of porous formation 14 as it washes fluid 16 therefrom.

In the alternative embodiment shown in FIG. 2 wherein the supply of other fluid 18 is derived entirely from separate layer 28 of said at least one other fluid 18, pump 56 forces said other fluid 18 into said injection opening 50 and the resulting pressure causes said other fluid 18 to be forced through said porous formation 14 and thus said fluid 18 migrates toward opening 40 and also migrates downward by the force of gravity into the separate layer 28 thereof. In the process, hydrocarbon 16 is washed from formation 14 and migrates toward opening 40 and downward into separate layer 26 thereof. In operation the at least one other fluid 18 may be continuously withdrawn from separate layer 28 through fluid transfer line 27 and fluid transfer pipe 57 by injection pump 56 and forced through injection line 55 into the porous formation 14 and back into the separate layer 28 thereof. The injecting process can be continuous so that separate fluid layer 28 reaches an equilibrium level wherein the amount withdrawn from said separate layer 28 and the amount injected are equal and the level of layer 28 is maintained.

The configuration shown in FIG. 2 allows the hydrocarbon 16 to form in separate layer 26 and to be withdrawn through pipe 30, having portion 32 inserted into said separate layer 26. Since desired fluid 16 is withdrawn separately from other fluid 18 and since other fluid 18 is continuously replaced into the underground formation 14, several benefits are achieved. For example, where at least one other fluid 18 naturally exists in porous formation 14, it need not be disposed of in ecologically safe but expensive surface disposal areas because it is not extracted to begin with. Only hydrocarbon 16 is conveyed to the surface 12. Also, the pressure within the porous formation 14 is only reduced due to the volume of desired fluid 16 recovered and the pressure is not reduced by any substantial amount due to the volume of said other fluid 18 which is circulated. Energy is also saved because other fluid 18 is not being pumped to the surface. Finally, since the separation occurs under the conditions existing in the porous formation 14, separation need not be achieved under conditions at the surface, which surface conditions might be conducive to undesirable and potentially dangerous chemical reactions.

Figure 3:
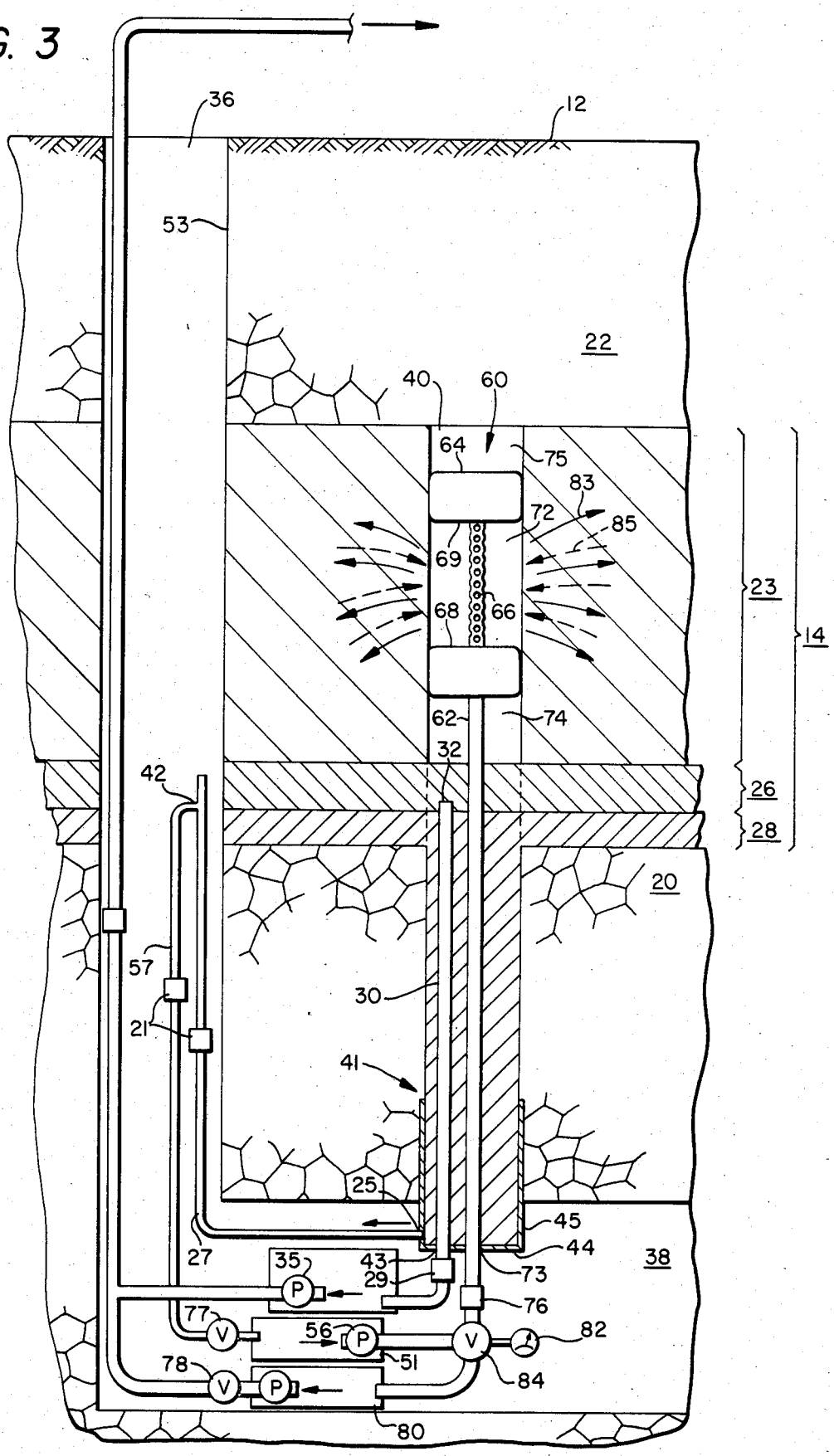
FIG. 3 is a cross-sectional schematic of the system for recovering fluid hydrocarbon from an underground source showing an alternative embodiment of a means for circulating at least one other fluid through said porous formation wherein the alternative means is a production/completion packer.
Figure 4:
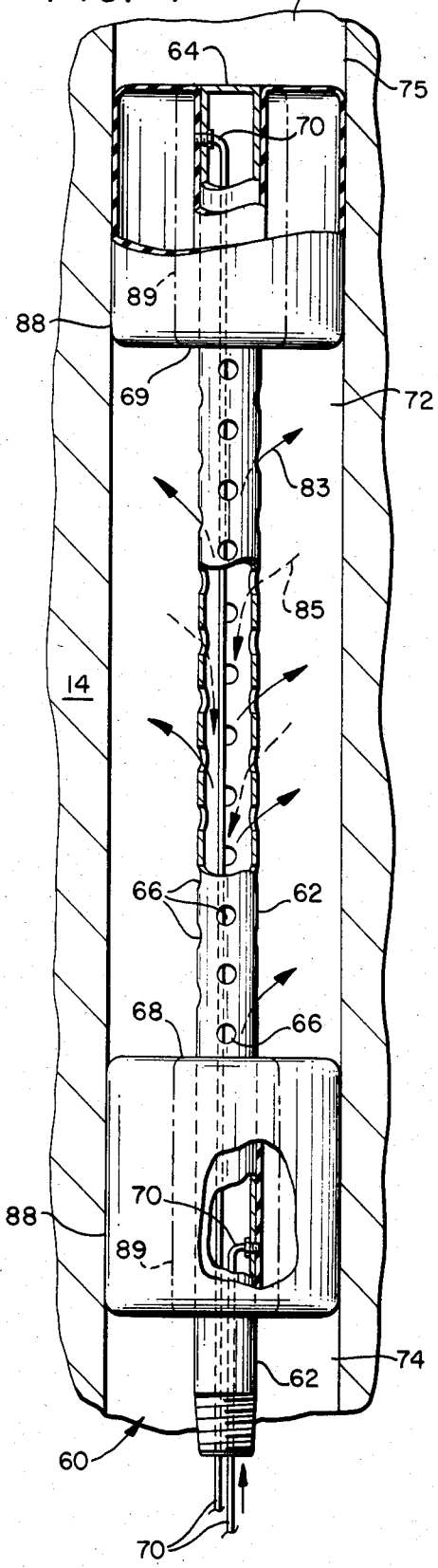
FIG. 4 is a detailed schematic and partial cross section of a production/completion packer shown in a preferred embodiment thereof.

As can best be understood with reference to FIGS. 3 and 4, in which FIG. 3 is a partial cross-sectional schematic view of an alternative embodiment of the inventive device 10 and in which FIG. 4 is a detailed partial cross-sectional view of a production/completion packer 60, the means 51 for circulating the undesired fluid 18 through said porous formation 14 may comprise said production packer 60 inserted into said opening 40. The production packer 60 comprises a tube 62, at least one port 66 in tube 62, at least two contractably expandable seals 68 and 69 sealingly attached around tube 62, means 70 (shown in FIG. 4) for contractably expanding expandable seals 68 and 69, and means 76 attached to tube 62 for injecting undesired fluid 18 under pressure through tube 62 when expandable seals 68 and 69 are expanded. Tube 62 has a closed end 64 thereon sealingly inserted through said means 44 for closing said opening 40 and into said opening 40 above said separated layer 28 of other fluid 18. Said at least one port 66 in said tube 62 is formed adjacent said closed end 64 thereof and is moved to a point above said separate layer 28 of undesired fluid 18. Said at least two seals 68 and 69 may be expandable packers 68 and 69 which are sealingly attached around tube 62 in spaced apart relationship on either side of said at least one port 66. Means 70 is attached to said expandable packers 68 and 69 for contractably expanding said expandable packers against said porous formation 14 immediately surrounding said opening 40, whereby a portion 72 of said opening 40 above the separate layer 28 of said other fluid 18 is isolated from other portions 74 and 75 of said opening 40 above and below said spaced apart expandable packers 68 and 69. Means 51 for circulating other fluid 18 is attached to tube 62 and is in fluid communication with said other fluid 18 in said separate layer 28 through transfer pipe 57, junction 42, transfer line 27, fitting 25 and casing 45 in opening 40. Means 51 comprises pump 56 for injecting collected other fluid 18 under pressure through said tube 62 when the expandable packers 68 and 69 are expanded. Thus said other fluid 18 is forced out of said at least one port 66 and, because of the pressure created by pump 56, through said porous formation 14 adjacent to the opening 40 to further wash said hydrocarbon 16 from said porous formation 14 and into separate layer 26.

In the preferred embodiment production packer 60 is movable through a seal 73 in said means for closing 44 and may be raised or lowered to any desired location in said opening 40. This may be accomplished using coupling means 76 to increase or decrease the length of pipe 62. The production packers 68 and 69 are pneumatically inflatable donut-shaped packers each composed of a continuous membrance of resilient material which may be any of a number of known resilient polymers. As can be seen with reference to FIG. 4, means 70 for inflating or deflating packer means 68 or 69 comprises air pressure lines 70 which are connected to packers 68 and 69 so that they may be inflated (expanded) or deflated (contracted) by pressurizing or depressurizing lines 70. Pressurizing means are well known and thus not depicted in the drawings. FIG. 4 shows packers 68 and 69 in their inflated positions 88 with the deflated position 89 shown by phantom lines. Thus, in the deflated position production/completion packer 60 is movable to a selected portion 72 of said opening 40 above said separate layer 28 of other fluid 18. Packers 68 and 69 are then inflated so that said selected pattern 72 is isolated from other portions 74 and 75 of said opening 40.

In the preferred embodiment said at least one port 66 comprises a plurality of ports 66 in tube 62 with all of said ports 66 between packer means 68 and 69. This configuration provides for a uniform injection of other fluid 18 through porous formation 14 about isolated portion 72 of opening 40. As may be seen in FIGS. 3 and 4, the injection of other fluid 18 into said porous formation 14 is represented by solid arrows at 83.

As may further be seen with reference to FIG. 3, production/completion packer 60 further comprises means 80 connected to said tube 62 for recovering hydrocarbon 16 which hydrocarbon 16 flows from the porous formation 14, as indicated by dashed arrows at 85, into said tube 62 between said expanded packers 68 and 69 when production packer 60 is not used for injecting said other fluid 18. Production/completion packer 60 further comprises means 82 connected to said tube 62 for measuring the flow rate of fluids into said tube 62 between said expanded packers 68 and 69. Also, production/completion packer 60 comprises means 84 connected to said tube 62 for selecting the function provided by either said means 51 for circulating said other fluid 18, said means 80 for recovering said hydrocarbon 16 which flows into said tube 62 between said expanded expandable packers 68 and 69, said means 82 for measuring said flow of fluids into said opening 40 between said expanded expandable packers 68 and 69 or both said means 80 for recovering fluid and said means 82 for measuring flow. Means 84 for selecting either means 51, means 80, means 82 or both means 80 and 82 may be a known multiple position valve 84, which may be operated in concert with valves 77 and 78 to select the desired means and thus the desired function of production packer 60.

Figure 5:
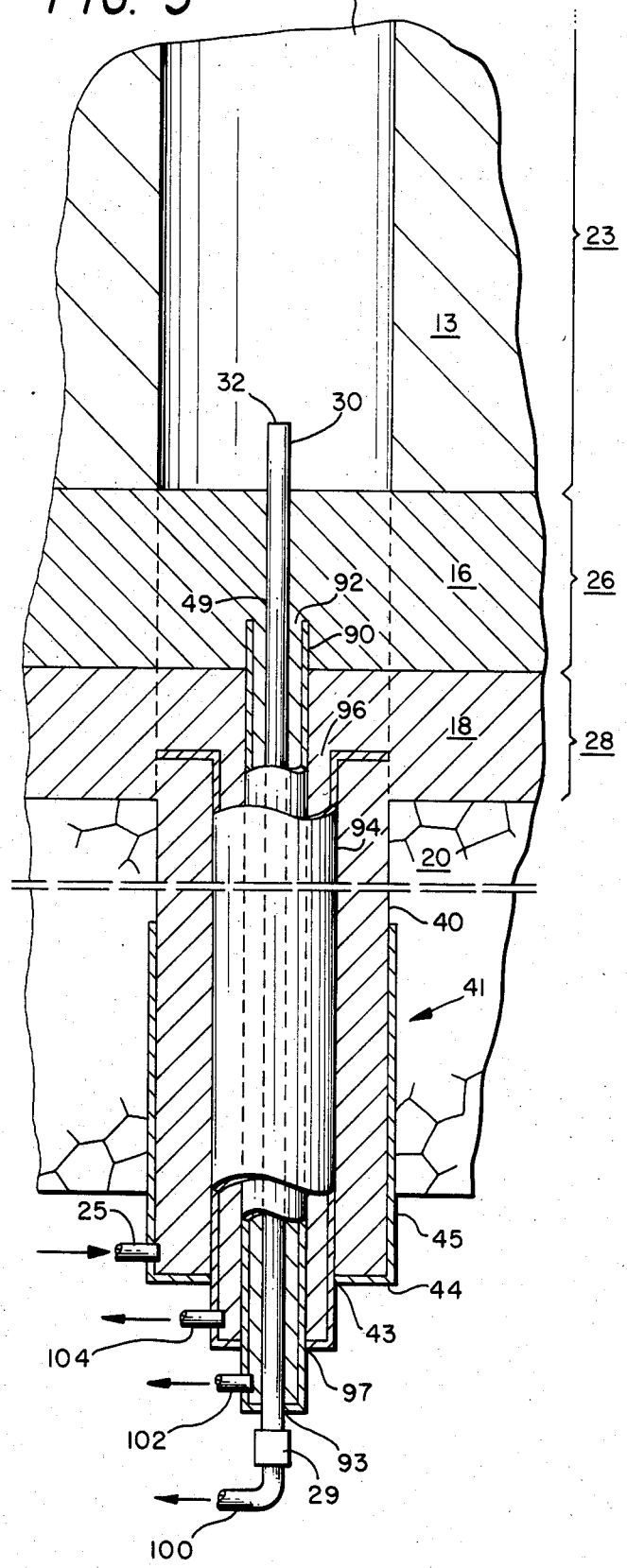
FIG. 5 is a detailed cross section of one alternative preferred embodiment of a means for recovering more than one desired fluid hydrocarbon from said porous formation and showing a plurality of pipes inserted into a plurality of separate layers of desired fluid hydrocarbons.

As may be seen with reference to FIGS. 1 and 5, the present invention includes within its scope a method and a device 10 for recovering more than one hydrocarbons 13 and 16 from an underground porous formation 14 containing said more than one hydrocarbon 13 and 16 and having a fluid impermeable bottom 20 thereto, which device comprises: means 51 for circulating fluid 18 through said porous formation 14 to wash said more than one fluid hydrocarbon 13 and 16 therefrom and to form separate pools 23 and 26, respectively, of said more than one hydrocarbons and a separate layer 28 of said at least one other fluid 18 adjacent said fluid impermeable bottom 20 of said porous formation 14 based on the specific gravity of said fluids; a means 41 for collecting more than one hydrocarbon and said at least one other fluid, which means 41 further comprises a group of a plurality of pipes 30, 90, and 94 each pipe with a portion, 32, 92, and 96, respectively, thereof inserted into said separate pools 23 and 26 and separate layer 28, respectively, whereby a separate one of said more than one hydrocarbons 13 or 16 or said other fluid 18 drains into a corresponding one of said plurality of pipes 30, 90, or 94 by the force of gravity.

In one embodiment at least one group of said plurality of pipes 30, 90, and 94, as indicated in FIG. 5, may all be inserted into at least one single opening 40 through casing 45 for closing said opening 40 and connected to means 34, not shown in FIG. 5, for conveying said separate hydrocarbons to the surface 12 which means 34 may be a plurality or recovery tanks and conveyance pumps such as recovery tank 33 and conveyance pump 35 as shown in FIG. 1. However, in the preferred embodiment a multiplicity of groups are inserted into a multiplicity of openings 40. Thus it can be understood that where fluid collection means 41 is shown in FIGS. 1, 2 and 3 comprising hydrocarbon collection means 49 which comprises collection pipe 30, said group of a plurality of pipes 30, 90 and 94, as shown in FIG. 5, may replace collection pipe 30 and thus hydrocarbon collection means 49 comprises pipes 30 and 90. Pipe 94 in the embodiment as shown in FIG. 5 is for collecting other fluid 18.

The plurality of pipes 30, 90, and 94 of each group further comprise concentrically connected pipes each with a diameter smaller than the pipe surrounding it and each with a portion thereof extending above said surrounding pipe and into said separate pools of said more than one hydrocarbon above or into said separate layer of fluid 18, whereby one of said more than one hydrocarbon drains into a corresponding one of said plurality of pipes by the force of gravity.

In the embodiment shown in FIG. 5 a first pipe 30 having the smallest diameter of all of said plurality of pipes has a portion 32 thereof which extends into said first pool 23 of desired first hydrocarbon 13, which first hydrocarbon 13 may be a gaseous hydrocarbon 13 having the least specific gravity of any of the more than one fluids in said porous formation 14. A second pipe 90 which has a portion 92 which extends into a second separate pool 26 of a second 16 one of said hydrocarbons is concentrically connected and movably sealed around said first pipe 30 by a first means 93 for concentrically connecting and sealing. Said second hydrocarbon 16 has a specific gravity less than that of said first hydrocarbon 13. Portion 92 of second pipe 90 permits said second hydrocarbon 16 to drain into said second pipe 90. A third pipe 94 is concentrically connected and movably sealed around said second pipe 90 by second means 97 for concentrically connecting and sealing. Third pipe 94 has a diameter greater than said second pipe 90. Further, third pipe 94 has a portion 96 thereof extending into a third separate layer 28 of said at least one other fluid 18 in said porous formation 14. Portion 96 is below portion 92 of said second pipe 90 and permits said at least one other fluid 18 in said porous formation 14 to drain by the force of gravity into third pipe 94. Said third pipe 94 is concentrically attached and movably sealed inside opening 40 through casing 45 for closing said opening 40. Thus device 10 may include the plurality of pipes in combination with means 51 for circulating at least one other fluid 18 through porous formation 14 and means 34 for conveying hydrocarbons to the surface as described previously in these specifications. Thus, each pipe 30, 90, and 94 may be independently moved and adjusted for collecting separate desired fluid hydrocarbons 13 or 16 or said at least one other fluid 18.

Each of said plurality of pipes 30, 90, and 94 is connected by connection means 100, 102, and 104, respectively, to means 34 for separately conveying said one of said more than one fluids from each of said plurality of pipes 30, 90, and 94 to the surface. Connection means 100, 102, and 104 are shown schematically in FIG. 15 as broken pipes but are intended to connect to means 34, which means 34 may comprise separate recovery tanks, such as recovery tank 33 in FIG. 1, and separate conveyance pumps, such as conveyance pump 35 in FIG. 1, for pumping each separate fluid to other locations for use or storage. Also casing 45 is intended to be connected to means 24 for adjusting the amount of other fluid 18 which in turn is connected to means 51 for circulating fluid 18 through porous formation 14. The connection is through pipe fitting 25 and through transfer line 27 and transfer pipe 57. It should also be understood that the particular separate recovery tank 33 and conveyance pump 35 which are part of recovery means 34 and which are connected to connection means 104, can be used to extract other fluid 18 where an excess thereof is present in formation 14. Alternatively connection means 104 may be closed. Where a multiplicity of groups of said plurality of pipes is employed, multiple means 34 for conveying said hydrocarbons to the surface may be used, each means 34 with a plurality of separate conveyance pumps and recovery tanks for each separate hydrocarbon. However, where the recovery rate is slow there may be a single means 34 with a plurality of separate conveyance pumps and recovery tanks corresponding in number to the number of fluids being recovery. Likewise, multiple means 51 for circulating said collected other fluid 18 may be used; however, if the size of the formation 14 is small there may only be a single means 51 for circulating said other fluid 18. Further, where circulating means 51 comprises a production/completion packer 60, said production/completion packer 60 may be inserted concentrically through pipe 90 in place of pipe 30 so that the entire system 10 is achievable through a single opening 40.

While the invention has been described in connection with preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A method for recovering a desired fluid hydrocarbon from an underground porous formation having a bottom impermeable to said fluid hydrocarbon and containing said hydrocarbon and at least one other fluid having a specific gravity different from said hydrocarbon, comprising the steps of:

a. forming an excavation having a portion thereof below said porous formation;

b. forming a plurality of openings extending from said portion of said excavation into said porous formation;

c. inserting collection means into said porous formation through said openings to separately collect said hydrocarbon and said at least one other fluid;

d. collecting a quantity of said at least one other fluid;

e. circulating said collected at least one other fluid from said porous formation to a point below said porous formation and at least one time back through said porous formation to wash said hydrocarbon therefrom and to form, in said porous formation, a pool of said hydrocarbon and a substantially separate layer of said at least one other fluid;

f. regulating the height of said hydrocarbon collection means and the volume of said collected at least one other fluid in said porous formation to maintain said hydrocarbon collection means in fluid communication with said pool of hydrocarbon;

g. collecting said hydrocarbon from said pool thereof; and h. conveying said collected hydrocarbon to the surface.

2. A method as in claim 1 wherein said step of collecting a quantity of said at least one other fluid comprises the steps of:

a. preventing said at least one other fluid from freely escaping through said openings, so that said at least one other fluid accumulates in a substantially separate layer in and about said openings; and b. permitting said quantity of said at least one other fluid to enter said fluid collection means.

3. A method as in claim 2 wherein said step of circulating said collected at least one other fluid comprises the steps of:

a. continuously draining said quantity of said at least one other fluid which enters into said fluid collection means to a fluid collection vessel in said excavation below said porous formation;

b. continuously pumping said drained at least one other fluid from said collection vessel into a means for injecting said at least one other fluid above said separate layer of said at least one other fluid; and c. continuously injecting said pumped at least one other fluid into said porous formation above said separate layer of said at least one other fluid, whereby said at least one other fluid washes said hydrocarbon from said porous formation as said at least one other fluid returns through said porous formation to said separate layer thereof.

4. A method as in claim 3 wherein said specific gravity of said at least one other fluid is greater than that of said fluid hydrocarbon and the step of regulating the height of said hydrocarbon collection means and the volume of said collected at least one other fluid in said porous formation comprises the steps of:

a. adjusting the amount of at least one other fluid which drains from said porous formation;

b. adjusting the rate of injection of said at least one other fluid into said porous formation so that the volume of fluid in said separate layer and therefore the height of said separate layer in said porous formation is regulated; and c. adjusting said inserted means for collected hydrocarbon to a position where a portion thereof is above said separate layer of said at least one other fluid and said portion is in fluid communication with said pool of hydrocarbon thereabove.

5. A system for recovering fluid hydrocarbon from an underground porous formation containing said fluid hydrocarbon interspersed within porous interstices of said porous formation and containing at least one other fluid having a specific gravity different than that of said hydrocarbon, a portion of said at least one other fluid in a substantially separate layer horizontally through said porous formation adjacent a formation bottom impermeable to said fluid hydrocarbon and which underground porous formation has an excavation thereunder and at least one opening from said excavation up into said porous formation, comprising:

a. means inserted through said at least one opening for circulating a quantity of said at least one other fluid from said separate layer thereof to a point below said formation and then up and through said porous formation to wash said interspersed hydrocarbon therefrom and into a pool of said hydrocarbon substantially separate from said substantially separate layer of said at least one other fluid and to return said at least one other fluid to said substantially separate layer thereof;

b. means inserted through said at least one opening for collecting said hydrocarbon from said pool thereof from below;

c. means in fluid communication with said means for collecting said hydrocarbon for conveying said collected hydrocarbon to above the ground.

6. A system for recovering fluid hydrocarbon from an underground porous formation containing said fluid hydrocarbon interspersed within porous interstices of said porous formation and containing at least one other fluid having a specific gravity different than that of said hydrocarbon, a portion of said at least one other fluid in a substantially separate layer horizontally through said porous formation adjacent a formation bottom impermeable to said fluid hydrocarbon and which underground porous formation has an excavation thereunder and at least one opening from said excavation up into said porous formation, comprising:

a. means inserted through said at least one opening for circulating a quantity of said at least one other fluid from said separate layer thereof to a point below said formation and then up and through said porous formation to wash said interspersed hydrocarbon therefrom and into a pool of said hydrocarbon substantially separate from said substantially separate layer of said at least one other fluid and to return said at least one other fluid to said substantially separate layer thereof, said circulating means including:

i. at least one casing having a closeable portion thereof affixed in said at least one opening with said closeable portion below said formation;

ii. a pumping means below said formation connected to said at least one casing in fluid communication with said separate layer of said at least one other fluid; and iii. injection means in fluid communication with said pumping means for conducting said at least one other fluid from said pump into said porous formation above said separate layer thereof, whereby said at least one other fluid flows down through said porous formation by the force of gravity washing said interspersed hydrocarbon from said porous formation and into said pool thereof as said at least one other fluid settles into said separate layer thereof;

b. means inserted through said at least one opening for collecting said hydrocarbon from said pool thereof from below;

c. means in fluid communication with said means for collecting said hydrocarbon for conveying said collected hydrocarbon to above the ground.

7. A system as in claim 6 wherein said injection means comprises at least one production completion packer inserted sealingly through said closeable portion of said casing into said at least one opening in said porous formation, said production/packer comprising:

a. a movable tube in fluid communication with said pumping means for receiving and conducting said at least one other fluid from said pumping means and having a closed end thereon sealingly inserted through said closeable portion of said casing and into said opening above said separate layer of said at least one other fluid for receiving said at least one other fluid under pressure from said pumping means;

b. at least one upper expandable packer seal sealingly attached around said movable tube adjacent said closed end of said tube;

c. at least one lower expandable paker seal sealingly attached around said movable tube in a spaced apart relationship below said upper expandable packer seal;

d. means for expanding said expandable upper and lower packer seals against said porous formation about said at least one opening when said lower packer seal has a portion thereof above said layer of said at least one other fluid so that a portion of said at least one opening is isolated from other portions of said opening from above and below;

e. at least one port in said movable tube between said upper and lower expandable packer seals, whereby said at least one other fluid under pressure in said movable tube is injected through said porous formation adjacent said isolated portion of said at least one opening.

8. A system as in claim 7 wherein:

a. said at least one closeable opening, comprises a plurality of closeable openings in spaced apart relationship;

b. said means for collecting said hydrocarbon from said separate pool thereof, comprises a plurality of means for collecting said hydrocarbon each sealingly inserted through one of said plurality of closeable openings with a portion of each of said plurality of means for collecting in fluid communication with said pool of hydrocarbon, whereby said hydrocarbon is collected into each of said plurality of means for collecting; and c. said means for conveying said collected hydrocarbon to above ground is in fluid communication with more than one of said plurality of means for collecting hydrocarbon.

9. A system for recovering a plurality of fluid hydrocarbons having various specific gravities from an underground porous formation containing said fluid hydrocarbons interspersed within the interstices of said porous formation and containing another fluid having a specific gravity different than that of any of said hydrocarbons, a portion of said other fluid in a substantially separate layer horizontally through said porous formation adjacent a fluid impermeable bottom to said underground porous formation and which underground porous formation has an excavation thereunder and at least one opening from said excavation up into said porous formation, comprising:

a. means for circulating a quantity of said other fluid from said separate layer thereof to a point below said formation and then up and through said porous formation to wash said interspersed hydrocarbons therefrom and into substantially separate pools of said hydrocarbons substantially separate one from the other and from said substantially separate layer of said other fluid and to return said other fluid to said separate layer thereof;

b. at least one group of concentric pipes each with a different diameter and each with a portion thereof concentricly inserted through said at least one opening into a corresponding separate pool of one of said plurality of hydrocarbons, whereby a separate one of said plurality of hydrocarbons drains into said corresponding one of said concentric pipes assisted by the force of gravity; and c. means for conveying said separate one of said plurality of hydrocarbons from each of said concentric pipes to aboveground.

10. A system as in claim 9 wherein:

a. said at least one opening, comprises a plurality of openings in spaced apart relationship;

b. said at least one group of concentric pipes for collecting said hydrocarbons from said separate pools thereof, comprises a multiplicity of groups of said concentric pipes, each group sealingly inserted through one of said plurality of openings with a portion of each pipe in each of said groups in fluid communication with said pools of hydrocarbons, so that one of said hydrocarbons is collected into a corresponding one of said pipes in each of said groups; and c. said at least one means for conveying said collected hydrocarbons to aboveground comprises a plurality of means each of which is in fluid communication with one of said pipes from more than one of said groups of said pipes, whereby each of said plurality of hydrocarbons is conveyed to above-ground separately.

11. A system for recovering fluid hydrocarbon from an underground porous formation containing said fluid hydrocarbon interspersed within porous interstices of said porous formation and containing at least one other fluid having a specific gravity different than that of said hydrocarbon, a portion of said at least one other fluid in a substantially separate layer horizontally through said porous formation adjacent a formation bottom impermeable to said fluid hydrocarbon and which underground porous formation has an excavation thereunder and at least one single opening from said excavation up into said porous formation, comprising:

a. means inserted through said at least one single opening for circulating a quantity of said at least one other fluid from said separate layer thereof to a point below said formation and then up and through said porous formation to wash said interspersed hydrocarbon therefrom and into a pool of said hydrocarbon substantially separate from said substantially separate layer of said at least one other fluid and to return said at least one other fluid to said substantially separate layer thereof;

b. means inserted through said at least one single opening for collecting said hydrocarbon from said pool thereof from below at the same time said at least one other fluid is being circulated; and c. means in fluid communication with said means for collecting said hydrocarbon for conveying said collected hydrocarbon to above the ground.

* * * * *